United States Patent [19]

Berdyansky et al.

[11] 3,931,724

[45] Jan. 13, 1976

[54] PLUG-RETAINING DEVICE FOR USE IN PIERCING AND PLUGGING MILLS

[76] Inventors: Mark Grigorievich Berdyansky, ulitsa Dzerzhinskogo, 24, kv. 17; Zarislav Zakharovich Khodak, ulitsa Dzerzhinskogo, 24, kv. 22; Vladimir Fomich Veevnik, ulitsa Orlovskaya, 24-a, kv. 21; Vladimir Semenovich Dovgan, ulitsa Vozdukhoflotskaya, 1, kv. 8; Vladimir Porfirievich Bashkatov, ulitsa Kosiora, 12, kv. 40; Vladimir Khrisanfovich Kasyan, ulitsa Naberezhnaya, 1, kv. 132; Konstantin Fedorovich Bezkrovny, prospekt Pushkina, 25/27, kv. 39; Lev Izrailevich Tsekhnovich, ulitsa Kirova, 8, kv. 8, all of Dnepropetrovsk, U.S.S.R.

[22] Filed: Aug. 14, 1974

[21] Appl. No.: 497,498

[52] U.S. Cl. ..... 72/97; 72/209

[51] Int. Cl.[2] ..... B21B 25/02

[58] Field of Search ..... 72/97, 209

[56] References Cited

UNITED STATES PATENTS

| | | | |
|---|---|---|---|
| 2,480,381 | 8/1949 | Offutt | 72/97 |
| 2,780,119 | 2/1957 | Holmquist | 72/97 |
| 3,030,835 | 4/1962 | Krause | 72/209 |

*Primary Examiner*—Lowell A. Larson

*Attorney, Agent, or Firm*—Haseltine, Lake & Waters

[57] ABSTRACT

A device for use in piercing and plugging mills, comprising a rod with a plug and a gear, for keeping the rod from longitudinal displacements under the effect of the load arising during the piercing or plugging. The gear includes a fixed thrust bearing accommodating a revolving casing through which passes the rod that reciprocates in operation. A part of the internal surface of the revolving casing forms a working cone that faces the plug with its base. The gear also includes a lock to fix the rod when piercing or plugging a billet, and preferably mounted on the rod, and a drive for carrying the rod with the plug. The lock mounts a spring-biased cone positively encompassed round the circumference with radially floating cams. Before piercing, the spring-biased cone is slightly drawn off by the spring from the cams so that the latter can enter the lock which is then able to enter the casing. At the moment piercing is effected, the cone, admitted together with the cams into the casing, gets completely between the cams, forcing them against the working cone of the casing and blocking up (wedging) the rod within the casing. Piercing or plugging completed, the spring draws the cone off again from the cams, the latter enter, and the rod with the plug can be displaced by the drive into its initial position.

1 Claim, 8 Drawing Figures

PLUG-RETAINING DEVICE FOR USE IN PIERCING AND PLUGGING MILLS

The present invention relates to the production of seamless pipes on pipe- and tube-rolling units with oblique-roller piercing and plugging mills and more particularly to plug-retaining devices for use in piercing and plugging mills.

Oblique-roller mills with plug-retaining devices as their inherent components are incorporated in all pipe- and tube-rolling units and behave as piercing or plugging mills or both. A mill for helical rolling comprises a mill proper and a group of gears of the plug-retaining device.

The design of the plug-retaining device which determines the duration of auxiliary operations when piercing (plugging) billets stipulates to a great extent the production rate of the entire pipe- and tube-rolling unit. Moreover, alongside with an enhancement of the mill production, the construction of the plug-retaining device conditions and allows the possibility of automation of a billet piercing (plugging) line.

Depending on the arrangement of the plug-retaining device the existing piercing (plugging) mills are subdivided into those with side or with axial delivery of a hollow billet. The mills with the side delivery are superior in production, require smaller shop floor areas, and a lower metal consumption.

A main disadvantage of the mills with the side delivery resides in that a plug-retaining bearing proper is displaced in such mills together with the rod. Heavy movable masses of the plug-retaining bearing largely complicate mill automation and restrict the speeds of both the rolling unit and the plug withdrawal. The known automatic control systems of the plug-retaining bearings are based on the use of computers, are very sophisticated and feature low reliability; therefore they have not found wide application.

The use of the plug-retaining devices with the axial delivery of pierced billets is expedient only in newly built shops, their utilization in the existing shops being associated with heavy outlays on shop reconstruction. According to literature and catalogue data as well as to patent material, no information is available from foreign countries on piercing and plugging mills with the axial delivery.

Progress in the plug-retaining devices of the piercing (plugging) mills is directed at providing plug-retaining bearings with minimum movable masses. In such devices only the rod with the plug are movable, the plug-retaining bearing proper being fixed. The provision of the above devices enables a 3–4-fold reduction in the movable masses, and owing to this stabilization of rod starting and stopping is achieved at the moment the plug is set up and withdrawn. A reduction in the movable masses of the bearing allows using simple and reliable automatic control systems based on standard apparatus.

The known plug-retaining devices employed in the piercing or plugging of billets with the side delivery of pierced billets comprise: a thrust bearing moving along the rolling axis together with a rod and plug fixed therein, a gear for securing the bearing in a working position, a drive for longitudinal transfer of the bearing together with the rod and plug, and slideways along which the bearing moves.

The movable thrust bearing together with the rod and plug mounted thereon in antifriction bearings is designed to take up considerable axial loads up to several tens of tons, that arise during piercing or plugging, with the rod rotating at a speed of 900 rpm and over.

Piercing completed, the rod with the plug and plug-retaining device are shifted to an extreme rear position to release the pierced billet and throw it on a receiving grating of the next unit.

Also known is a plug-retaining device furnished, in contrast to the previous one, with a non-rotatable rod with a plug which is turned prior to each piercing cycle. The device is provided with a movable thrust bearing incorporating the rod with the plug and a gear for turning the rod and the plug prior to the piercing operation.

In both cases the thrust bearing, shifting together with the rod, features a considerable weight which diminishes the speed of its travel and does not exclude blows in an extreme front and rear position. The heavy weight of the thrust bearing increases the duration of auxiliary operations at the exit side of the mill, and in addition the blows in the extreme positions reduce the service life on the plug-retaining device. In the front position (during piercing) the plug-retaining bearing is fixed with the help of a special lock which is engaged and disengaged by an individual drive requiring an additional response time which, in turn, increases the duration of auxiliary operations at the exit side of the mill.

Also known are plug-retaining bearings whose inherent design allows reducing their displacement time and accordingly that of auxiliary operations at the exit side of a piercing (plugging) mill owing to a reduction of the movable bearing masses (see, e.g., U.S. Pat. No. 2,480,381, granted in 1949).

These devices comprises a stationary thrust head including a casing, a socket, radial thrust bearings, pneumatic drives with a leverage system, ensuring rod striking and rotation during the piercing operation, rapid displacement of the cams and withdrawal of the rod as well as positional adjustment of the plug in the deformation focus. In this case both the return and the front stroke times of the rod with the plug are reduced owing to a decrease in the movable masses.

However, with the above devices the time of auxiliary operations includes additional time for the bringing together and separation of the cams holding in place the rod with the plug. Moreover, the bearing structure in the above devices is complicated due to the cam arrangement proper.

Known in the art is a plug-retaining device for use in piercing and plugging mills for producing cylindrical pipe billets, comprising a rod with a plug, the rod being set up along the rolling axis of the mill, to be capable of reciprocating therealong and passing through a gear, for keeping the rod from longitudinal displacement under the effect of the load brought about by piercing or plugging. The gear is arranged on the rolling axis and includes a fixed thrust bearing accommodating a revolving casing so that a portion of its internal surface forms a working cone facing the plug with its base, a retainer and a lock for securing the rod with the working cone of the revolving casing at the moment of piercing or plugging, the lock being mounted on the rod in the rolling direction behind the fixed thrust bearing; the gear includes also a drive for transferring the rod with the plug to working and initial positions (see Author's Certificate of the USSR No. 229419).

The lock of the above plug-retaining device is made as a chuck whose leaves constitute rod extensions and take up the axial force of piercing or plugging, and transmit the torque from the rod to the revolving casing of the thrust bearing. Moreover, the chuck leaves are designed for a high number, up to 6000, of variable-sign cycles per 24 hours.

Owing to the intricate shape of the leafs and the great number of cycles performed under heavy loads, the chucks are costly and feature low reliability in operation. Moreover, the known structural material cannot provide the requisite number of cycles without failure of the chuck leaves at their joints with the rod.

It is an object of the invention to overcome the above disadvantages.

The main object of the present invention is to provide a plug-retaining device for use in piercing and plugging mills which is simple and reliable in service, owing to a new lock for securing a rod with the plug at the moment the billet is pierced or plugged.

Another object of the invention is the provision of a plug-retaining device which makes it possible to enhance the production of a piercing or plugging mill be increasing the rate of displacement of the rod with the plug, reducing thereby the time for such auxiliary operations as the setting up of the plug in the deformation focus and its withdrawal from the pipe after piercing or plugging, to be brought in its initial position.

These and other objects of the invention are achieved in the novel plug-retaining device according to the invention, for use in piercing and plugging mills for producing hollow cylindrical pipe billets, the device comprising a rod with a plug, the former being arranged along the mill rolling axis, to be able to reciprocate therealong and passing through a gear for keeping the rod from longitudinal displacements under the effect of the load arising during the piercing or plugging. The gear is arranged on the mill rolling axis and includes a fixed thrust bearing accommodating a revolving casing, with a portion of its internal surface forming a working cone that faces the plug with its base, a retainer and a lock for securing the rod within the working cone at the instant of the piercing or plugging. The lock is mounted on the rod in the rolling direction behind the fixed thrust bearing. Preferably the gear also includes a drive for moving the rod with the plug into its working and initial position.

According to important features of the invention, the lock is provided with a wedge in the form of a truncated cone, longitudinally spring-biased to the rod and facing the plug with its apex, and with cams positively encompassing the wedge, the cams being arranged in one slots about the circumference of the rod, preferably in one the same plane, and floating in radial directions, adapted to secure the rod in its working position, and prevent it from being axially displaced relative to the revolving retainer-carrying casing of the fixed thrust bearing. The cams mate with their external surfaces with the working cone, as the wedge shifts with respect to the rod in the direction opposite to the rolling direction, at the moment the rod interacts with the retainer, to block the rod within the revolving casing; while alternatively the external surfaces of the cams come out of engagement with the working cone when the wedge moves in the rolling direction, so that the rod with the plug can be returned to its initial position.

It is recommended that the retainer be made as a spring-biased bush to protect the device from blows.

The present invention thus relates to the provision of a plug-retaining device featuring a simple and dependable arrangement, making it possible to increase the rate of movement of the rod with the plug, diminishing thereby the time for such auxiliary operations as the setting up of the plug in the deformation focus and its withdrawal from the pipe after piercing or plugging, to be brought in its initial position, and enhancing labour productivity.

The present invention will be better understood from a consideration of a detailed description of an exemplary embodiment thereof, to be had in conjunction with the accompanying drawings, wherein.

Figure 1:
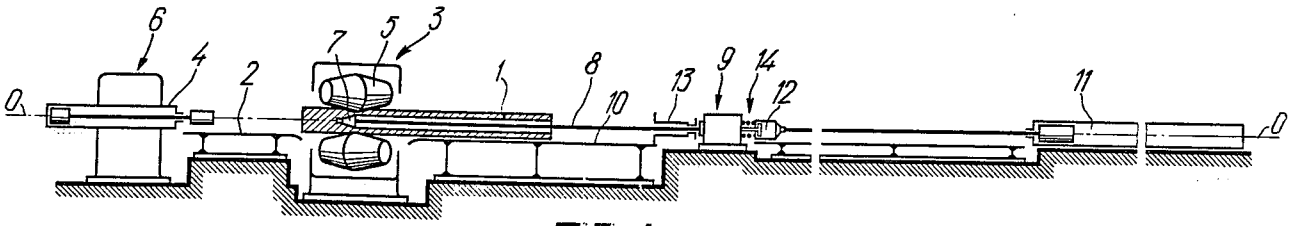
FIG. 1 is a schematic layout in a longitudinal section of a piercing mill with a plug-retaining device according to the invention at the moment a billet is being pierced.

In a schematic illustration of a piercing mill (FIGS. 1 and 2) a billet 1 is admitted into a trough 2 at the entry side of a piercing mill 3. Then the billet 1 is fed by a feeding gear 4 between oblique work rolls 5 of the piercing mill 3, which are brought into rotation by an electric motor (not shown in the drawing) through a pinion stand 6. The billet 1 rotated by the work rolls 5 is pulled axially onto a plug 7 of a rod 8 of a plug-retaining device 9, the plug 7 being mounted in a deformation focus, and is pierced to form a hollow cylindrical billet, 1*a*. Once piercing is completed, the billet 1*a* is arranged in a trough 10 at the exit side of the piercing mill. To deliver the pierced billet to a next unit (not shown in the drawing) of a pipe- and tube-rolling plant and for piercing the next billet, the plug 7 of the rod 8 is withdrawn from the billet 1*a* with the help of a carriage 12 and a pneumatic rod transfer drive 11 disposed along the rolling axis 0—0 at the exit side of the piercing mill and placed in a sprayer 13 wherein it is cooled with high-pressure water. As soon as the pierced billet 1*a* is removed from the trough 10, the plug 7 is again set up in the deformation focus in its working position, as shown in FIG. 1. Then the cycle is repeated.

Figure 4:
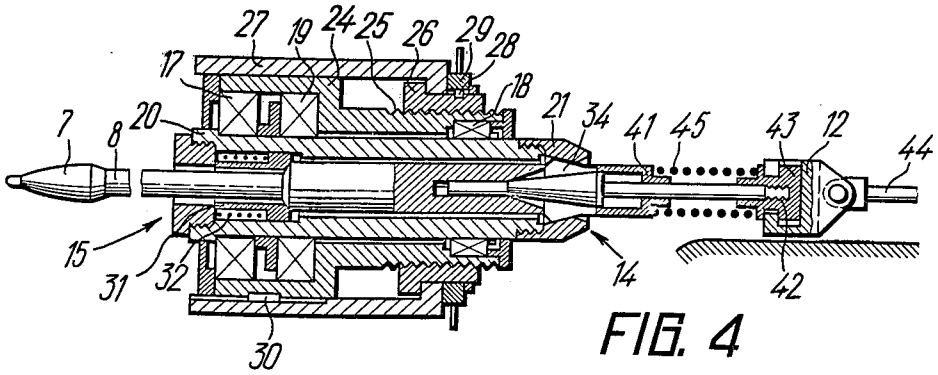
FIG. 4 is the same as FIG. 3, at the moment the rod with the plug is fixed in their working positions, when piercing the billet.
Figure 3:
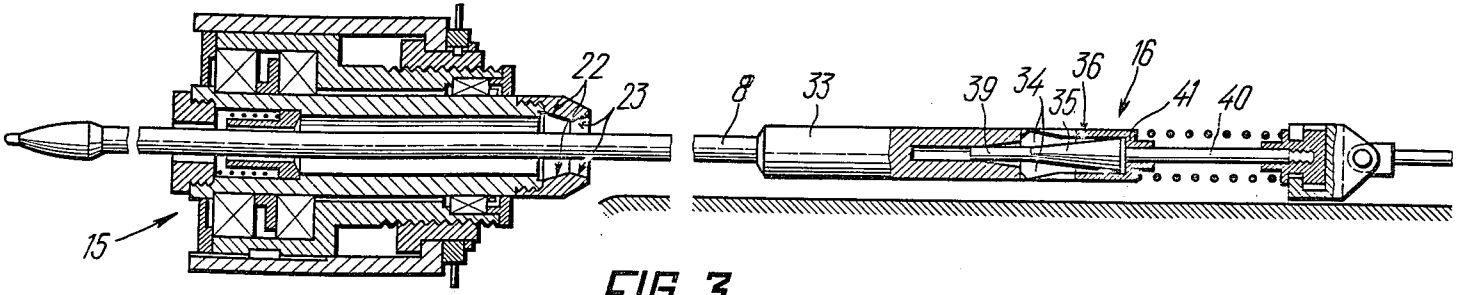
FIG. 3 is a longitudinal sectional view of a plug-retaining device according to the invention with a rod and a plug in their initial positions.

The plug-retaining device 9 presented in FIGS. 3 and 4 comprises the rod 8 with the plug 7, a gear 14 for keeping the rod from longitudinal displacements under the effect of the load arising during the piercing operation, and the rod transfer drive 11.

The gear 14 includes a fixed thrust bearing 15 and a lock 16 to secure the rod therein. The fixed thrust bearing 15 accommodates a revolving casing 20 mounted in radial bearings 17 and 18 and a thrust bearing 19. On the casing 20 is fixed a replaceable thrust head 21 whose internal surface forms a working cone 22 whose base is directed to the side opposite to the rolling direction, with the opposite side of the cone 22 connected to the base of a guide cone 23.

At the moment piercing is effected the axial force is transmitted through the surface of the working cone 22 and the thrust bearing 19 to a movable socket 24, and through a buttress thread 25 and a back nut 26 to a housing 27 mounted on a foundation (not shown in the drawing).

The back nut 26 is capable of rotating by means of a socket (steering wheel) 29 set up on a key 28, shifting the socket 24 along a key 30 within the housing 27 and changing thereby the position of the working cone 22 of the thrust head 21. By varying the position of the working cone 22 the setting of the plug 7 in the deformation focus can be adjusted when passing over to the piercing of billets of another diameter.

The revolving casing 20 accommodates a thrust sleeve 31 with a spring 32 which serves for damping the rod securing lock 16 when it is engaged.

Figure 6:
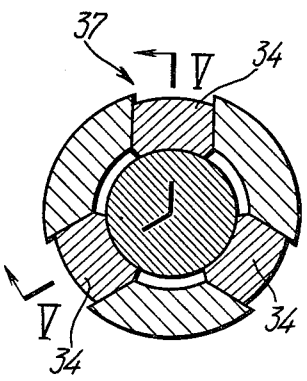
FIG. 6 is a section VI—VI in FIG. 5.
Figure 5:
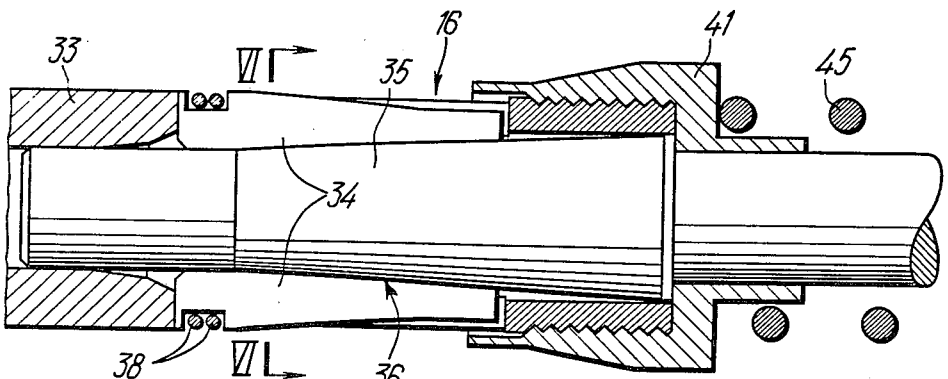
FIG. 5 is a longitudinal sectional view of a lock with the rod placed in its initial position corresponding to section V—V—V in FIG. 6.
Figures 7, 8:
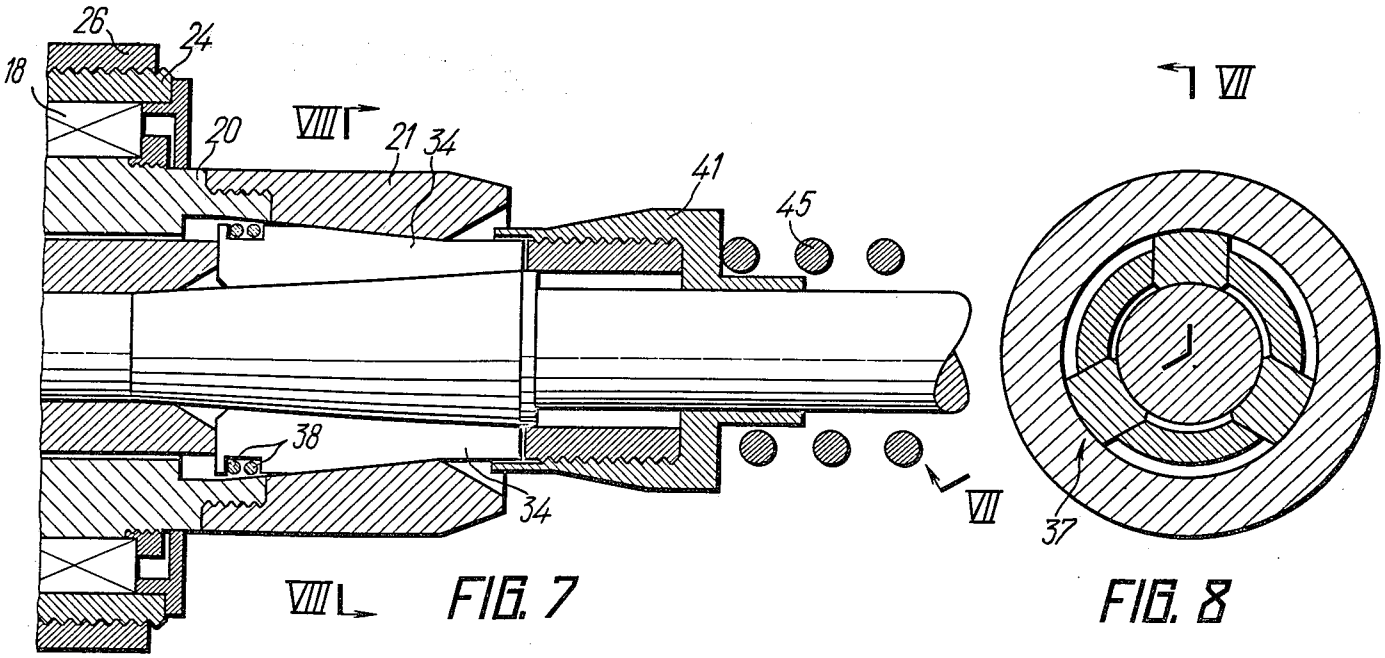
FIG. 7 is a longitudinal sectional view of a lock with the rod in its working position, section VII—VII of FIG. 8.
FIG. 8 is a section VIII—VIII of FIG. 1.

The lock 16 is mounted in a tail portion 33 of the rod 8 and is provided with floating cams 34 (FIGS. 3, 4, 5 and 6), with their external and internal surfaces being tapered and mating at the instant the rod is fixed with the surface of the working cone of the thrust head 21 and that of a truncated cone 35 of a movable wedge 36. The cone 35 is set up on the wedge 36 with its apex facing the plug 7. The cams 34 are placed in axial slots 37 (FIGS. 6, 8) of the tail portion 33 of the rod 8 round the circumference in the same plane and forced against the cone 35 by a helical spring 38 (FIGS. 5 and 7). A cylindrical front stem 39 and a rear stem 40 of the wedge 36 are centered, the stem 39 being centered in the tail portion 33 of the rod 8 and the stem 40 in a back nut 41 (FIGS. 3, 4, 5 and 7) screwed on the tail portion 33 of the rod 8.

The rear cylindrical stem 40 terminates with a thread 42 on which is screwed a sleeve 43 which serves to connect the rod 8 through the stem 40 to the carriage 12 coupled with a rod 44 of a long-stroke air cylinder 11 for transferring the rod 8.

Mounted intermediate of the sleeve 43 and the nut 41 is a helical spring 45 which tends to press the cone 35 against the back nut 41.

The herein-proposed plug-retaining device operates in the following manner. In the initial position (FIG. 2) the pierced billet 1*a* is arranged in the outlet trough 10 between the piercing mill 3 and the sprayer 13. To deliver the pierced billet 1*a* to the next unit of the pipe- and tube-rolling plant and to pierce a new billet, the rod 8 with the plug 7 is turned clockwise until the plug 7 is withdrawn from the billet 1*a* and set up in the sprayer 13 to be cooled therein.

As soon as the outlet trough 10 is emptied and thus ready for piercing the next billet 1 (which by that moment has been delivered to the inlet trough 2), the plug 7 is mounted between the rolls 5 of the piercing mill 3 and secures the rod 8 in the thrust bearing 15 with the aid of the rod-keeping gear 14.

The plug 7 being set up, the gear 4 feeds the billet 1 to be pierced into the rolls 5 of the mill 3.

Figure 2:
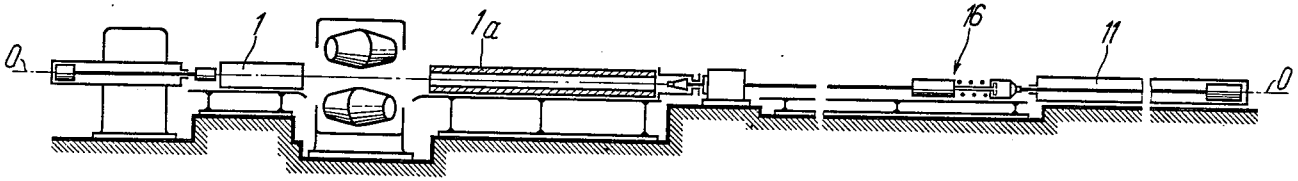
FIG. 2 is the same as FIG. 1, after completion of the piercing operation and the return of the rod with the plug into its initial position.

Upon piercing the next billet the drive 11 returns the rod 8 with the plug 7 to their extreme right-hand (initial) positions shown in FIGS. 2 and 3. The cone 35 is pressed by the helical spring 45 against the internal end face of the back nut 41 (FIG. 3). The cams 34 are forced by the helical spring 38 against the working surface of the cone 35 and do not protrude above the surface of the tail portion 33 of the rod 12 (FIG. 5). The spring 45 is precompressed by a force exceeding the resistance encountered in the outlet trough 10 and in the revolving casing 20 of the fixed thrust bearing 15 as the rod 8 shifts to the work rolls 5 (FIG. 3).

When the rod 8 moves from its initial to its working position to set up the plug 7 in the deformation focus between the rolls 5 of the mill 3 before piercing is initiated, the wedge 36 is not displaced axially within the tail portion 33 of the rod 8 since the resistance of the displaced rod does not exceed the precompression force of the spring 45.

As the front end face of the tail portion 33 of the rod 8 approaches the back nut 31, the spring 45 is compressed with the force created on the rod 44 of the pneumatic drive 11 which serves to transfer the rod 8. In this case the wedge 36 transfers within the tail portion 33 of the rod 8 and the cone 35 draws apart the cams 34 overcoming the force of the helical spring 38.

When the cams 34 are drawn apart, their external tapered surfaces mate with that of the working cone 22 of the thrust head 21 (FIG. 4) which transmits the piercing force through the casing 20, bearings 17, 18 and 19 and the movable socket 24 to the housing 27 of the fixed thrust bearing 15. The piercing force adds to a wedging force, blocking up the cams 34 and keeping the wedge 36 from being displaced.

After the piercing operation has been started, air pressure within the piston air cylinder (of the rod pneumatic drive) 11 is decreased, the rod being fixed only by the axial piercing force.

Piercing being completed, the spring 45 shifts the wedge 36 until the cone 35 strikes against the back nut 41.

The rod 8 with the plug 7 is ready to return to its initial (extreme right-hand) position, as shown in FIG. 2.

As the hollow billet 1a passes to the trough 10 at the exit side of the mill, the pneumatic drive 11 transfers the rod with the plug into their initial positions.

Further, all the operations are repeated in the abovedescribed sequence.

The herein-proposed plug-retaining devices has been manufactured and subjected to industrial test on an operating mill. As shown by the tests and experiments, the rod and plug setting-up and withdrawal time was reduced by 1.5 to 1.8 times as compared with piercing mills furnished with movable thrust bearings, which enabled a substantial increase in labor productivity.

What we claim is:

1. A plug-retaining device for use in a piercing and plugging mill for producing hollow cylindrical pipe billets, comprising, in combination: a rod with a plug, said rod being set up along the rolling axis of the mill, reciprocable therealong, and having axial slots about its circumference; a gear arranged on the rolling axis, through which gear said rod and said plug pass, for keeping said rod from axial displacements under the effect of the load arising during the piercing and plugging of the billets; said gear including a fixed thrust bearing, a revolving casing enclosed within said bearing, with a portion of the internal surface of said casing forming a working cone that faces said plug with its base, a lock for securing said rod with said plug in said cone at the moment of the piercing and plugging, said lock being set up on said rod in the rolling direction behind said bearing and provided with a wedge longitudinally spring-biased to said rod and made as a cone facing said plug with its apex, and cams arranged in said slots, floating in radial directions, positively encompassing said cone, to fix said rod in its working position, to preclude the axial displacements with respect to said casing; said gear being fitted with means for shifting said rod with said plug, and with a retainer disposed within said casing, said retainer being made as a spring-biased bush for engaging said lock; whereby, as said wedge is displaced in relation to said rod in the direction opposite to the rolling direction, at the moment said rod interacts with said retainer, said cams mate with their external surfaces with said cone, thereby blocking said rod within said casing; while, as said wedge moves in the rolling direction, said external surfaces are brought out of engagement with said cone, thereby enabling said rod with said plug to return to its initial position.

* * * * *